US010921101B2

(12) United States Patent
Burrow et al.

(10) Patent No.: US 10,921,101 B2
(45) Date of Patent: Feb. 16, 2021

(54) MULTI-PIECE POLYMER AMMUNITION CARTRIDGE

(71) Applicant: TRUE VELOCITY IP HOLDINGS, LLC, Dallas, TX (US)

(72) Inventors: Lonnie Burrow, Carrollton, TX (US); Christopher William Overton, Richardson, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

(21) Appl. No.: 15/886,337

(22) Filed: Feb. 1, 2018

(65) Prior Publication Data

US 2019/0137243 A1 May 9, 2019

Related U.S. Application Data

(63) Continuation of application No. 15/808,859, filed on Nov. 9, 2017.

(51) Int. Cl.

| | |
|---|---|
| ***F42B 5/307*** | (2006.01) |
| ***F42C 19/08*** | (2006.01) |
| ***F42B 5/313*** | (2006.01) |

(52) U.S. Cl.

CPC ..... *F42B 5/307* (2013.01); *F42B 5/313* (2013.01); *F42C 19/083* (2013.01)

(58) Field of Classification Search

CPC ..... F42B 5/307; F42B 5/313
USPC ..... 102/465, 466
See application file for complete search history.

(56) References Cited

U.S. PATENT DOCUMENTS

| | | | |
|---|---|---|---|
| 99,528 | A | 2/1870 | Boyd |
| 113,634 | A | 4/1871 | Crispin |
| 130,679 | A | 8/1872 | Whitmore |
| 159,665 | A | 2/1875 | Gauthey |
| 169,807 | A | 11/1875 | Hart |
| 462,611 | A | 11/1891 | Comte de Sparre |

(Continued)

FOREIGN PATENT DOCUMENTS

| | | | |
|---|---|---|---|
| CA | 2813634 | A1 | 4/2012 |
| DE | 16742 | C | 1/1882 |

(Continued)

OTHER PUBLICATIONS

AccurateShooter.com Daily Bulletin "New PolyCase Ammunition and Injection-Molded Bullets" Jan. 11, 2015.

(Continued)

*Primary Examiner* — Reginald S Tillman, Jr.
(74) *Attorney, Agent, or Firm* — Singleton Law, PLLC; Chainey P. Singleton

(57) ABSTRACT

The present invention provides polymeric ammunition having a generally cylindrical neck having a projectile aperture at a first end, an outer shoulder surface that extends from the generally cylindrical neck, an outer shoulder angle defined by the outer shoulder surface, an inner shoulder surface on the inside of the polymer nose opposite the outer shoulder surface, an inner shoulder angle defined by the outer shoulder surface, a skirt surface extending from the inner shoulder surface, a skirt angle defined by the skirt surface and a nose junction that extends from the outer shoulder surface to the skirt surface, wherein the nose junction is adapted to mate to a polymer cartridge.

16 Claims, 20 Drawing Sheets

(56) References Cited

U.S. PATENT DOCUMENTS 498,856 A 6/1893 Overbaugh
640,856 A 1/1900 Bailey
662,137 A 11/1900 Tellerson
676,000 A 6/1901 Henneberg
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,936,905 A 11/1933 Gaidos
1,940,657 A 12/1933 Woodford
2,294,822 A 9/1942 Norman
2,465,962 A 3/1949 Allen et al.
2,654,319 A 10/1953 Roske
2,823,611 A 2/1958 Thayer
2,862,446 A 12/1958 Lars
2,918,868 A 12/1959 Lars
3,099,958 A 8/1963 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,292,538 A 12/1966 Hans et al.
3,485,170 A 12/1969 Scanlon
3,485,173 A 12/1969 Morgan
3,609,904 A * 10/1971 Scanlon ..... F41A 15/04 102/466
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,797,396 A 3/1974 Reed
3,842,739 A 10/1974 Scanlon et al.
3,866,536 A 2/1975 Greenberg
3,874,294 A 4/1975 Hale
3,955,506 A 5/1976 Luther et al.
3,977,326 A 8/1976 Anderson et al.
3,990,366 A 11/1976 Scanlon
4,020,763 A 5/1977 Iruretagoyena
4,147,107 A 4/1979 Ringdal
4,157,684 A 6/1979 Clausser
4,173,186 A 11/1979 Dunham
4,187,271 A 2/1980 Rolston et al.
4,228,724 A 10/1980 Leich
4,475,435 A 10/1984 Mantel
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,867,065 A 9/1989 Kaltmann et al.
5,021,206 A 6/1991 Stoops
5,033,386 A 7/1991 Vatsvog
5,063,853 A 11/1991 Bilgeri
5,090,327 A 2/1992 Bilgeri
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
5,433,148 A 7/1995 Barratault et al.
5,535,495 A 7/1996 Gutowski
5,563,365 A 10/1996 Dineen et al.
5,770,815 A 6/1998 Watson
5,798,478 A 8/1998 Beal
5,950,063 A 9/1999 Hens et al.
5,961,200 A 10/1999 Friis
5,969,288 A 10/1999 Baud
6,004,682 A 12/1999 Rackovan et al.
6,048,379 A 4/2000 Bray et al.
6,070,532 A 6/2000 Halverson
6,272,993 B1 8/2001 Cook et al.
6,283,035 B1 9/2001 Olson et al.
6,357,357 B1 3/2002 Glasser
6,375,971 B1 4/2002 Hansen
6,450,099 B1 9/2002 Desgland
6,460,464 B1 10/2002 Attarwala
6,523,476 B1 2/2003 Riess et al.
6,649,095 B2 11/2003 Buja
6,672,219 B2 1/2004 Mackerell et al.
6,708,621 B1 3/2004 Forichon-Chaumet et al.
6,752,084 B1 6/2004 Husseini et al.
6,810,816 B2 11/2004 Rennard
6,840,149 B2 1/2005 Beal
6,845,716 B2 1/2005 Husseini et al.
7,000,547 B2 2/2006 Amick
7,014,284 B2 3/2006 Morton et al.
7,032,492 B2 4/2006 Meshirer
7,056,091 B2 6/2006 Powers
7,059,234 B2 6/2006 Husseini
7,165,496 B2 1/2007 Reynolds
7,204,191 B2 4/2007 Wiley et al.
7,213,519 B2 5/2007 Wiley et al.
7,231,519 B2 6/2007 Joseph et al.
7,232,473 B2 6/2007 Elliott
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen
7,441,504 B2 10/2008 Husseini et al.
7,461,597 B2 12/2008 Brunn
7,585,166 B2 9/2009 Buja
7,610,858 B2 11/2009 Chung
7,750,091 B2 7/2010 Maljkovic et al.
7,841,279 B2 11/2010 Reynolds et al.
7,930,977 B2 4/2011 Klein
8,007,370 B2 8/2011 Hirsch et al.
8,056,232 B2 11/2011 Patel et al.
8,156,870 B2 4/2012 South
8,201,867 B2 6/2012 Thomeczek
8,206,522 B2 6/2012 Sandstrom et al.
8,240,252 B2 8/2012 Maljkovic et al.
8,408,137 B2 4/2013 Battaglia
8,443,729 B2 5/2013 Mittelstaedt
8,443,730 B2 5/2013 Padgett
8,511,233 B2 8/2013 Nilsson
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
8,875,633 B2 11/2014 Padgett
8,893,621 B1 11/2014 Escobar
8,978,559 B2 3/2015 Davies et al.
9,003,973 B1 4/2015 Padgett
9,032,855 B1 5/2015 Foren et al.
9,091,516 B2 7/2015 Davies et al.
9,103,641 B2 8/2015 Nielson et al.
9,157,709 B2 10/2015 Nuetzman et al.
9,170,080 B2 10/2015 Poore et al.
9,182,204 B2 11/2015 Maljkovic et al.
9,188,412 B2 11/2015 Maljkovic et al.
9,200,157 B2 12/2015 El-Hibri et al.
9,200,880 B1 12/2015 Foren et al.
9,212,876 B1 12/2015 Kostka et al.
9,212,879 B2 12/2015 Whitworth
9,213,175 B2 12/2015 Arnold

(56) References Cited

U.S. PATENT DOCUMENTS

| | | | |
|---|---|---|---|
| 9,254,503 | B2 | 2/2016 | Ward |
| 9,255,775 | B1 | 2/2016 | Rubin |
| 9,329,004 | B2 | 5/2016 | Pace |
| 9,335,137 | B2 | 5/2016 | Maljkovic et al. |
| 9,337,278 | B1 | 5/2016 | Gu et al. |
| 9,347,457 | B2 | 5/2016 | Ahrens et al. |
| 9,366,512 | B2 | 6/2016 | Burczynski et al. |
| 9,377,278 | B2 | 6/2016 | Rubin |
| 9,389,052 | B2 | 7/2016 | Conroy et al. |
| 9,395,165 | B2 | 7/2016 | Maljkovic et al. |
| D764,624 | S | 8/2016 | Masinelli |
| D765,214 | S | 8/2016 | Padgett |
| 9,429,407 | B2 | 8/2016 | Burrow |
| 9,441,930 | B2 | 9/2016 | Burrow |
| 9,453,714 | B2 | 9/2016 | Bosarge et al. |
| 9,500,453 | B2 | 11/2016 | Schluckebier et al. |
| 9,506,735 | B1 | 11/2016 | Burrow |
| 9,513,096 | B2 | 12/2016 | Burrow |
| 9,518,810 | B1 | 12/2016 | Burrow |
| 9,523,563 | B1 | 12/2016 | Burrow |
| 9,528,799 | B2 | 12/2016 | Maljkovic |
| 9,546,849 | B2 | 1/2017 | Burrow |
| 9,551,557 | B1 | 1/2017 | Burrow |
| D778,391 | S | 2/2017 | Burrow |
| D778,393 | S | 2/2017 | Burrow |
| D778,394 | S | 2/2017 | Burrow |
| D778,395 | S | 2/2017 | Burrow |
| D779,024 | S | 2/2017 | Burrow |
| 9,587,918 | B1 | 3/2017 | Burrow |
| 9,599,443 | B2 | 3/2017 | Padgett et al. |
| 9,625,241 | B2 | 4/2017 | Neugebauer |
| 9,631,907 | B2 | 4/2017 | Burrow |
| 9,644,930 | B1 | 5/2017 | Burrow |
| 9,658,042 | B2 | 5/2017 | Emary |
| 9,683,818 | B2 | 6/2017 | Lemke et al. |
| 9,709,368 | B2 | 7/2017 | Mahnke |
| 9,759,554 | B2 | 9/2017 | Ng et al. |
| 9,784,667 | B2 | 10/2017 | Lukay et al. |
| 9,835,423 | B2 | 12/2017 | Burrow |
| 9,835,427 | B2 | 12/2017 | Burrow |
| 9,857,151 | B2 | 1/2018 | Dionne et al. |
| 9,869,536 | B2 | 1/2018 | Burrow |
| 9,885,551 | B2 | 2/2018 | Burrow |
| 9,921,040 | B2 | 3/2018 | Rubin |
| 9,927,219 | B2 | 3/2018 | Burrow |
| 9,933,241 | B2 | 4/2018 | Burrow |
| 9,939,236 | B2 | 4/2018 | Drobockyi et al. |
| 9,964,388 | B1 | 5/2018 | Burrow |
| 2003/0131751 | A1 | 7/2003 | Mackerell et al. |
| 2006/0260500 | A1 | 11/2006 | Engel et al. |
| 2007/0056343 | A1 | 3/2007 | Cremonesi |
| 2009/0314178 | A1 | 12/2009 | South |
| 2010/0275804 | A1 | 11/2010 | Trivette |
| 2011/0179965 | A1* | 7/2011 | Mason ..... F42B 5/307 102/467 |
| 2012/0011219 | A1 | 1/2012 | Zhang et al. |
| 2012/0037029 | A1 | 2/2012 | Klement |
| 2012/0111219 | A1 | 5/2012 | Burrow |
| 2012/0180688 | A1 | 7/2012 | Padgett |
| 2012/0199033 | A1 | 8/2012 | Bybee et al. |
| 2013/0014665 | A1 | 1/2013 | Maljkovic et al. |
| 2014/0060372 | A1 | 3/2014 | Padgett |
| 2014/0260925 | A1 | 9/2014 | Beach et al. |
| 2015/0226220 | A1 | 8/2015 | Bevington |
| 2015/0241183 | A1 | 8/2015 | Padgett et al. |
| 2015/0241184 | A1 | 8/2015 | Burrow |
| 2016/0003589 | A1 | 1/2016 | Burrow |
| 2016/0003590 | A1 | 1/2016 | Burrow |
| 2016/0003593 | A1 | 1/2016 | Burrow |
| 2016/0003594 | A1 | 1/2016 | Burrow |
| 2016/0003595 | A1 | 1/2016 | Burrow |
| 2016/0003596 | A1 | 1/2016 | Burrow |
| 2016/0003597 | A1 | 1/2016 | Burrow |
| 2016/0003601 | A1 | 1/2016 | Burrow |
| 2016/0033241 | A1 | 2/2016 | Burrow |
| 2016/0102030 | A1 | 4/2016 | Coffey et al. |
| 2016/0209186 | A1 | 7/2016 | Hajjar |
| 2016/0245626 | A1 | 8/2016 | Drieling et al. |
| 2016/0349023 | A1 | 12/2016 | Burrow |
| 2016/0349028 | A1 | 12/2016 | Burrow |
| 2016/0356581 | A1 | 12/2016 | Burrow |
| 2016/0356588 | A1 | 12/2016 | Burrow |
| 2016/0377399 | A1 | 12/2016 | Burrow |
| 2017/0080498 | A1 | 3/2017 | Burrow |
| 2017/0082409 | A1 | 3/2017 | Burrow |
| 2017/0082411 | A1 | 3/2017 | Burrow |
| 2017/0089673 | A1 | 3/2017 | Burrow |
| 2017/0089674 | A1 | 3/2017 | Burrow |
| 2017/0089675 | A1 | 3/2017 | Burrow |
| 2017/0089679 | A1 | 3/2017 | Burrow |
| 2017/0261294 | A1 | 9/2017 | Riess |
| 2018/0066925 | A1 | 3/2018 | Skowron et al. |

FOREIGN PATENT DOCUMENTS

| | | | |
|---|---|---|---|
| EP | 2625486 | A4 | 8/2017 |
| FR | 1412414 | A | 10/1965 |
| GB | 783023 | A | 9/1957 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |

OTHER PUBLICATIONS

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

* cited by examiner

MULTI-PIECE POLYMER AMMUNITION CARTRIDGE

CROSS-REFERENCE TO RELATED APPLICATIONS

This application incorporated the contents of each by reference in their entirety U.S. patent application Ser. No. 14/011,202 filed on Aug. 27, 2013 which is a Divisional Application of U.S. patent application Ser. No. 13/292,843 filed on Nov. 9, 2011 (now U.S. Pat. No. 8,561,543) which claims the benefit of U.S. Provisional Patent Application Ser. No. 61/456,664, filed Nov. 10, 2010.

This application claims the benefit of U.S. patent application Ser. No. 15/808,859, filed Nov. 9, 2017.

TECHNICAL FIELD OF THE INVENTION

The present invention relates in general to the field of ammunition, specifically to compositions of matter and methods of making and using polymeric ammunition cartridge casings having at least 2 portions.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacture requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

Shortcomings of the known methods of producing plastic or substantially plastic ammunition include the possibility of the projectile being pushed into the cartridge casing, the bullet being held too light such that the bullet can fall out, the bullet being held insufficient to create sufficient chamber pressure, the bullet pull not being uniform from round to round, and the cartridge not being able to maintain the necessary pressure, portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

BRIEF SUMMARY OF THE INVENTION

The present invention provided polymer ammunition cases (cartridges) injection molded over a primer insert and methods of making thereof. The present invention provided polymer ammunition noses that mate to the polymer ammunition cases to be loaded to make polymer ammunition and methods of making thereof.

The present invention provided polymeric ammunition having a 2 piece case comprising: an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess; a polymeric middle body comprising a polymeric body extending from a body coupling over at least a portion of the primer insert, wherein the polymeric body is molded over the cylindrical coupling element and into the primer flash hole aperture and into the groove to form a primer flash hole; a polymer nose comprising a generally cylindrical neck having a projectile aperture at a first end; an outer shoulder surface that extends from the generally cylindrical neck; an outer shoulder angle defined by the outer shoulder surface; an inner shoulder surface on the inside of the polymer nose opposite the outer shoulder surface; an inner shoulder angle defined by the outer shoulder surface; a skirt surface extending from the inner shoulder surface; a skirt angle defined by the skirt surface; and a nose junction that extends from the outer shoulder surface to the skirt surface, wherein the nose junction and the skirt are adapted to mate to the body coupling; a diffuser comprising a diffuser aperture positioned in the primer recess to align the diffuser aperture with the primer flash hole; a primer inserted into the primer recess; a propellant at least partially filling the propellant chamber; and a bullet frictionally fitted in the bullet-end aperture. The skirt is adapted to fit flush to the body coupling.

The nose junction is a groove and the skirt adjacent to the groove on the inside of the polymer nose and is adapted to mate to the body coupling. The nose junction is a half lap junction with the skirt on the inside of the polymer nose. The skirt is adapted to fit flush to a polymer cartridge. The includes an angle formed between the nose junction and the skirt is between 40 and 140 degrees. The angle formed between the nose junction and the skirt is about 90 degrees. The angle formed between the nose junction and the skirt is greater than 90 degrees. The angle formed between the nose junction and the skirt is less than 90 degrees. The shoulder comprises an outer shoulder surface having an outer angle opposite an inner shoulder surface having an inner angle and a skirt surface adjacent to the inner shoulder surface. The outer angle is the same as the inner angle. The polymer nose comprises a nylon polymer, polycarbonate polymer, polybutylene polymer or a mixture thereof. The polymer nose comprises a fiber-reinforced polymeric composite. The polymer nose comprises between about 10 and about 70 wt % glass fiber fillers, mineral fillers, or mixtures thereof. The polymer nose includes an adhesively groove is positioned in the projectile aperture. The polymer nose, the polymeric middle body or both individually comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, ionomers, polyamides, polyamide-imides, polyacrylates, polyetherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.56 mm, 7.62 mm and 0.50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The cartridges, therefore, are of a caliber between about 0.05 and about 5 inches. Thus, the present invention is also applicable to the sporting goods industry for use by hunters and target shooters.

Figure 1:
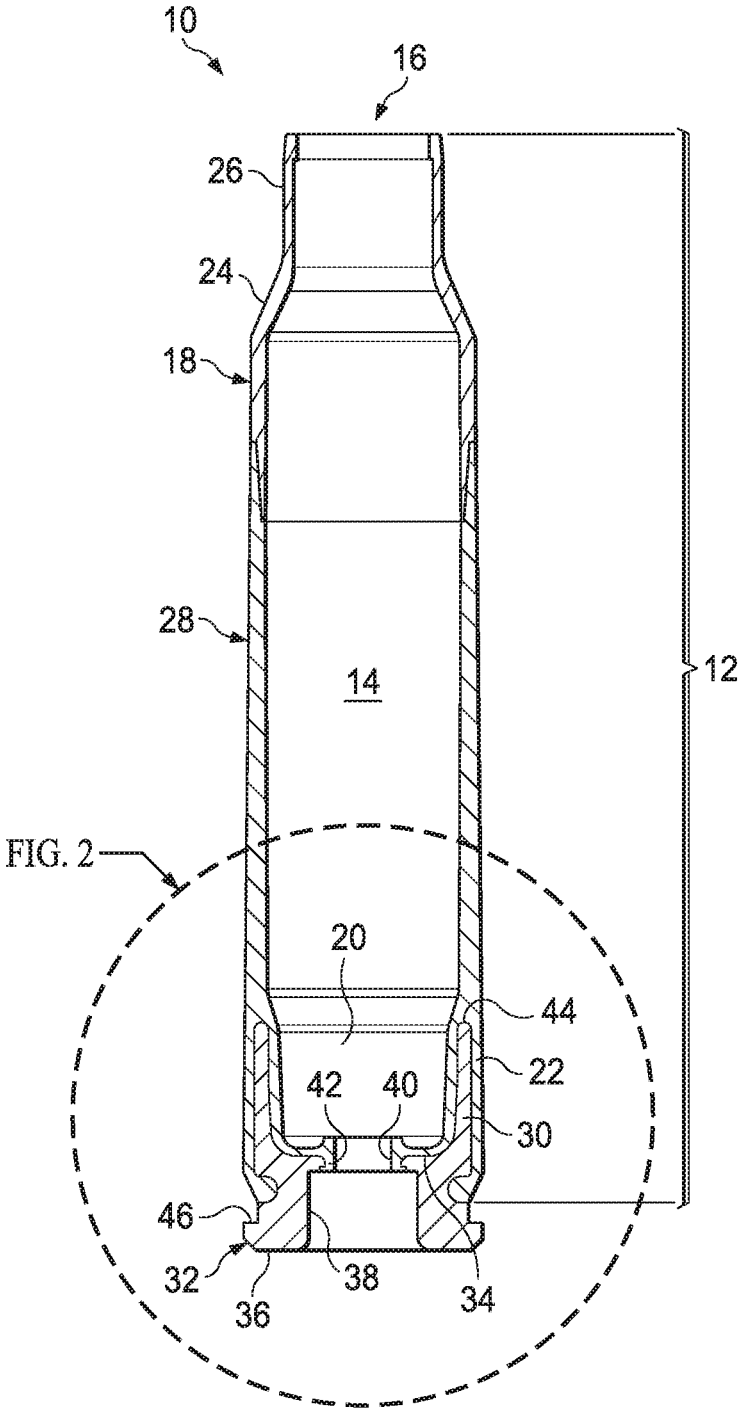
FIG. 1 depicts a side, cross-sectional view of a polymeric cartridge case according to one embodiment of the present invention.

FIG. 1 depicts a side, cross-sectional view of a polymeric cartridge case according to one embodiment of the present invention. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches.

The bullet-end 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used.

The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the powder chamber 14 so that upon detonation of primer (not shown) the powder in powder chamber 14 will be ignited.

Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures.

The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 2:
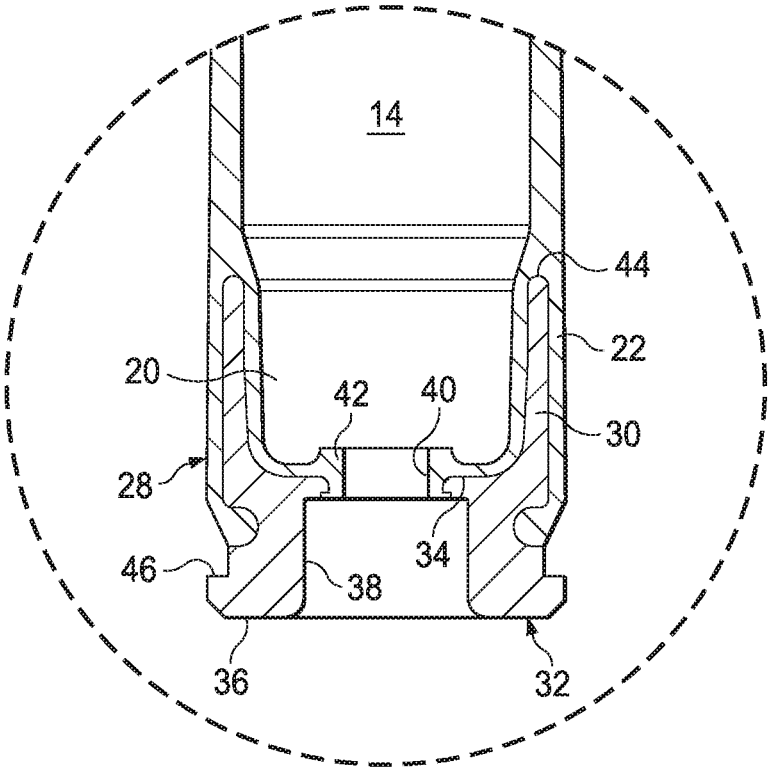
FIG. 2 depicts a side, cross-sectional view of a portion of the polymeric cartridge case according to one embodiment of the present invention.

FIG. 2 depicts a side, cross-sectional view of a portion of the polymeric cartridge case according to one embodiment of the present invention. A portion of a cartridge suitable for use with high velocity rifles is shown manufactured with a polymer casing 12 showing a powder chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

Figure 3:
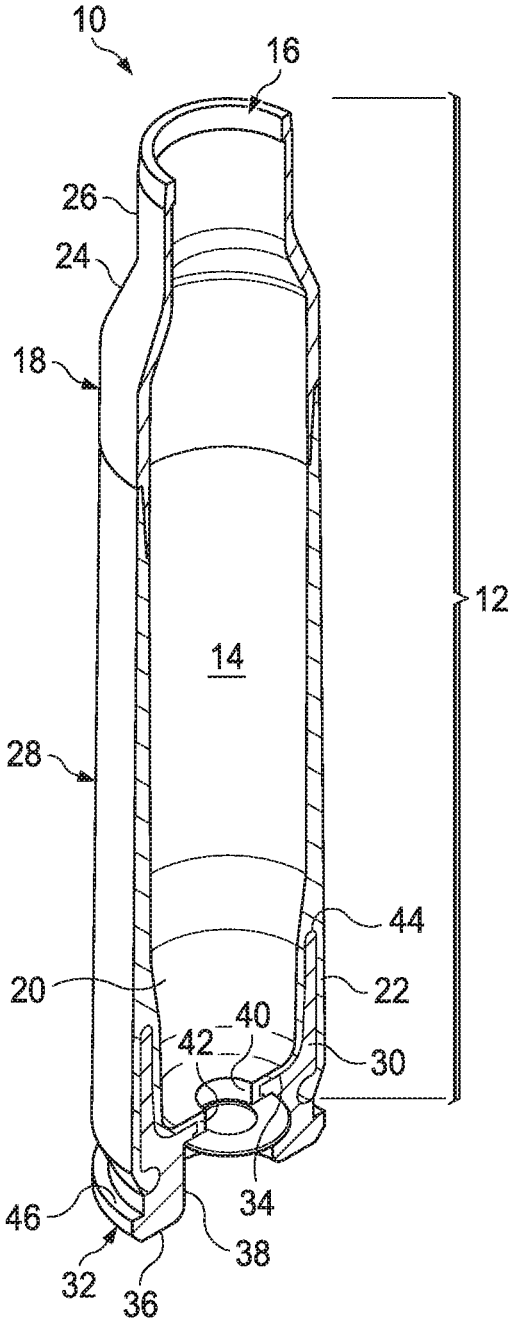
FIG. 3 depicts a side, cross-sectional view of a polymeric cartridge case having a diffuser according to one embodiment of the present invention.

FIG. 3 depicts a side, cross-sectional view of a polymeric cartridge case having a diffuser according to one embodiment of the present invention. The diffuser 50 is a device that is used to divert the affects of the primer off of the polymer and directing it to the flash hole. The affects being the impact from igniting the primer as far as pressure and heat. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to the opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provides support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. Located in the top surface 36 is a primer recess 38 that extends toward the bottom surface 34 with a diffuser 50 positioned in the primer recess 38. The diffuser 50 includes a diffuser aperture 52 that aligns with the primer flash hole 40. The diffuser 50 is a device that is used to divert the affects of the primer (not shown) off of the polymer. The affects being the impact from igniting the primer as far as pressure and heat to divert the energy of the primer off of the polymer and directing it to the flash hole.

Figure 4:
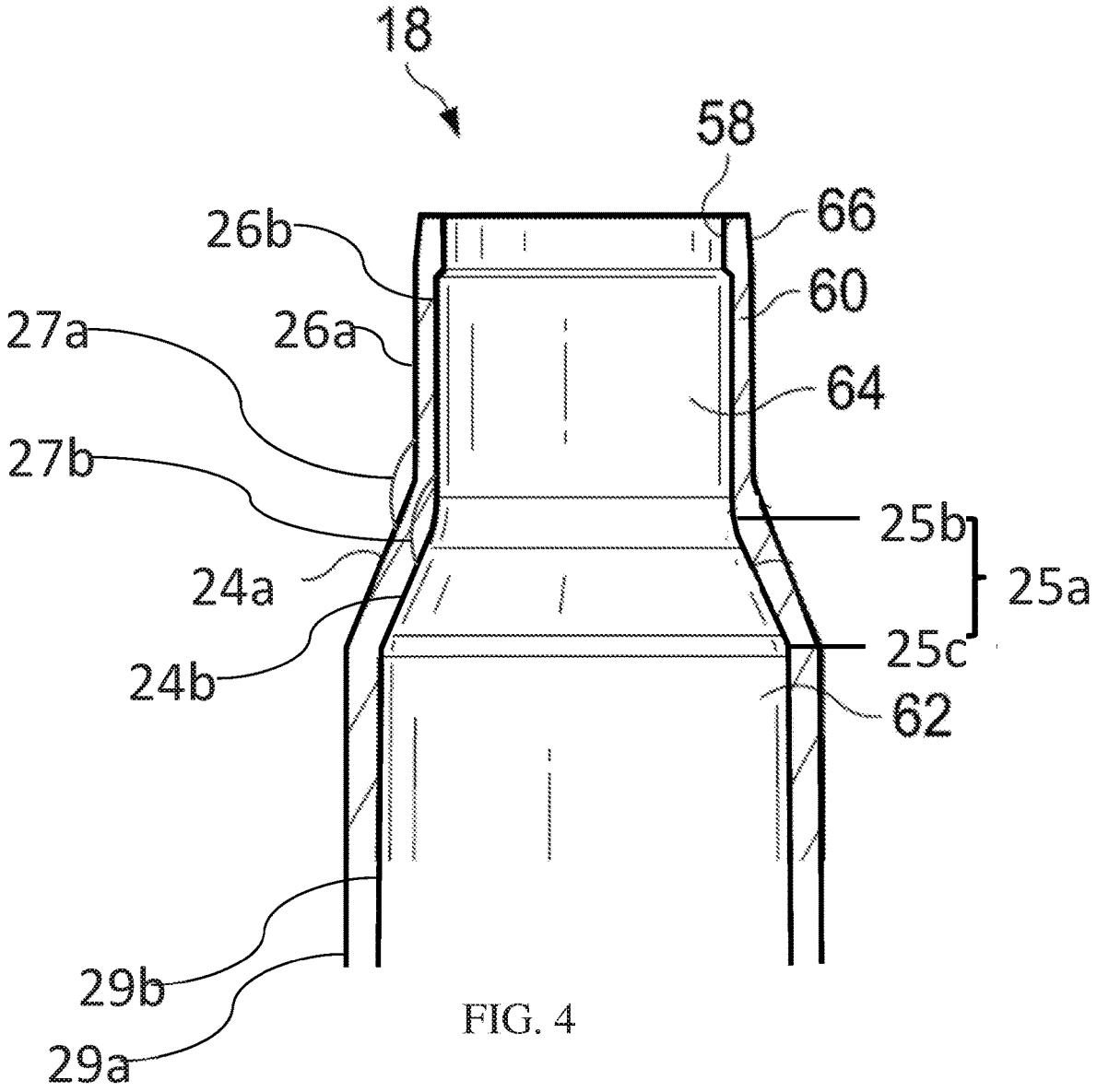
FIG. 4 depicts a partial view of a 2 piece polymer case having a nose and a mid-case connected at a joint.

FIG. 4 depicts a partial view of a 2 piece polymer case having a nose and a mid-case connected at a joint. The substantially cylindrical open-ended polymeric bullet-end 18 having a shoulder 24*a* forming chamber neck 26*a* and a bullet (not shown). One embodiment includes modifications to strengthen the neck of the mouth 58 and to the internal area 62 to reduce nose tearing and lodging in the chamber. The substantially cylindrical open-ended polymeric bullet-end 18 can include a lock (e.g., 0.030×0.003) and added a step to allow for the lock to flex out during firing. Polymer was added to the external area to strengthen the neck of the mouth 58 and to the internal area 62. The interference of the bullet to the neck 26*a* was increased by adding polymer to the inside of the neck 26*a* and the exit lock modified by adding an angle to the rim 66. The substantially cylindrical open-ended polymeric bullet-end 18 includes an external shoulder 24*a* and an external neck 26*a* that are a fixed dimension as requires by the chamber (not shown) in which they fit. As a result, the shoulder length extending from the external neck 26*a* to the external side wall 29*a* is of a fixed length. Similarly, the external shoulder plane angle 27*a* to the external neck 26*a* or alternatively to the external side wall 29*a* is fixed relative to the chamber. Similarly, the substantially cylindrical open-ended polymeric bullet-end 18 includes an internal shoulder 24*b* and an internal neck 26*b* that are not fixed dimension and may be varied as desired. As a result, the internal shoulder length 25*a* is determined by the distance from the internal shoulder top 25*b* that extends from the internal neck 26*b* to internal shoulder bottom 25*c* that extends from the internal side wall 29*b*. This internal shoulder length 25*a* may be varied as necessary to achieve the desired properties (e.g., pressure, velocity, temperature, etc.). The internal shoulder plane angle 27*b* is defined as the angle between the internal shoulder 24*b*, and the internal neck 26*b* or the angle between the internal shoulder 24*b* and the internal side wall 29*b*.

The external shoulder 24*a*, the external neck 26*a*, and the external shoulder plane angle 27*a* have fixed values to mate them to the chamber. The relationship between the external shoulder 24*a*, an external neck 26*a*, and external shoulder plane angle 27*a* are caliber ammunition and weapons platform specific and have values. In contrast, the internal shoulder 24*b*, the internal neck 26*b*, and the internal shoulder plane angle 27*b* have no such constraints and can be varied to form the desired internal shoulder profile.

For example, when the internal shoulder plane angle 27*b* is the same as the external shoulder plane angle 27*a* the external shoulder 24*a* and internal shoulder 24*b* are parallel. When the internal shoulder plane angle 27*b* is the same as the external shoulder plane angle 27*a*, the external shoulder 24*a* and internal shoulder 24*b* are parallel. When the internal shoulder plane angle 27*b* is the larger than the external shoulder plane angle 27*a*, internal shoulder 24*b* is longer than the external shoulder 24*a* such that the internal shoulder 24*b* transitions to the internal side wall 29*b* at a distance further away from the external shoulder 24*a*. Thus making a larger distance from the internal shoulder 24*b* to the external shoulder 24*a* as you move toward the shoulder bottom 25*c*. Conversely, when the internal shoulder plane angle 27*b* is the smaller than the external shoulder plane angle 27*a*, there is a larger distance from the internal shoulder 24*b* to the external shoulder 24*a* as you move up the shoulder toward internal shoulder 24*b*. As a result, the internal shoulder length 25*a* is determined by the distance from the internal shoulder top 25*b* that extends from the internal neck 26*b* to internal shoulder bottom 25*c* that extends from the internal side wall 29*b*. This internal shoulder length 25*a* may be varied as necessary to achieve the desired properties (e.g., pressure, velocity, temperature, etc.). The internal shoulder plane angle 27*b* is defined as the angle between the internal shoulder 24*b*, and the internal neck 26*b* or the angle between the internal shoulder 24*b* and the internal side wall 29*b*.

Figure 5:
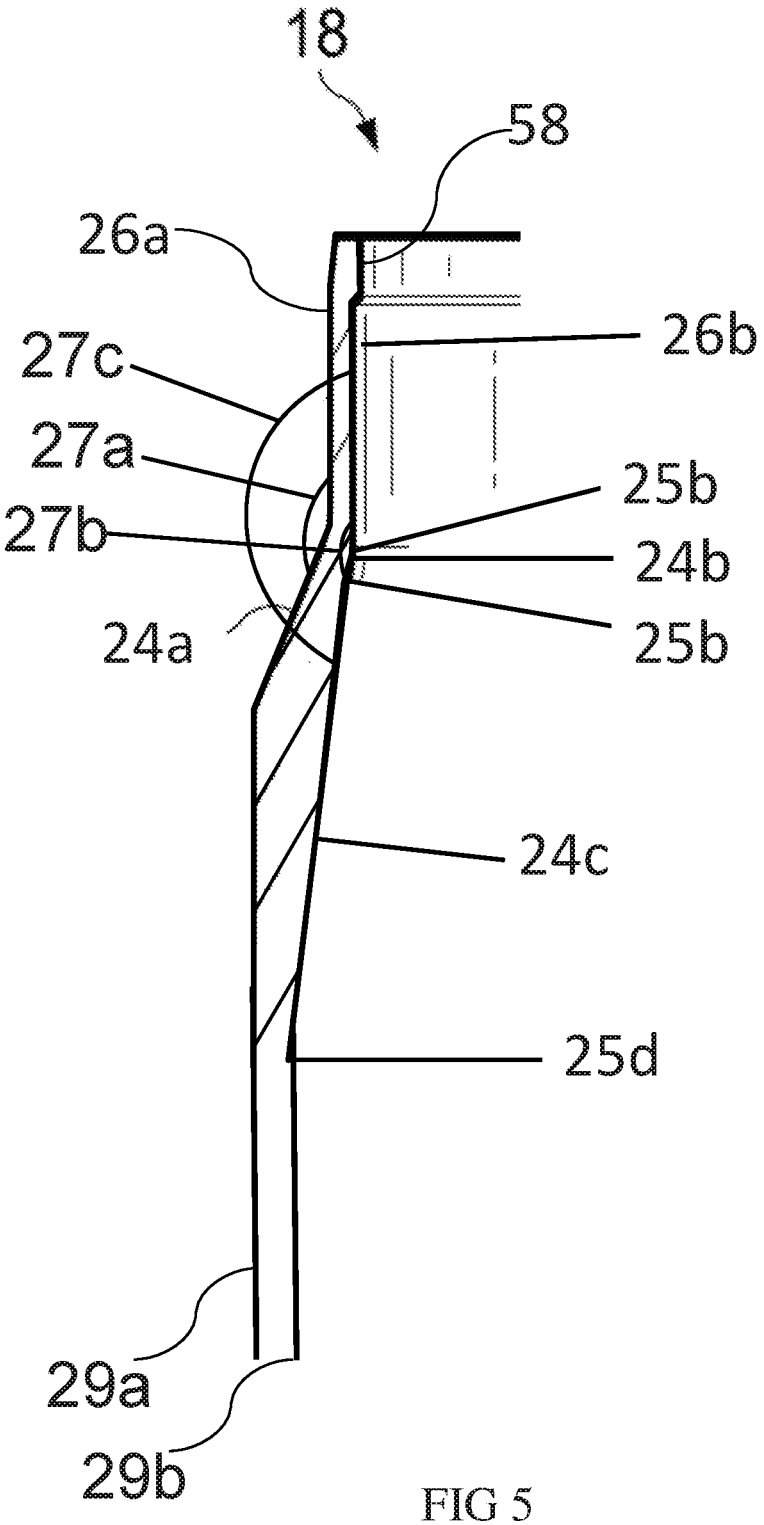
FIG. 5 depicts a partial view of a 2 piece polymer case having a nose and a mid-case connected at a joint.

FIG. 5 depicts a partial view of a 2 piece polymer case having a nose and a mid-case connected at a joint. FIG. 5 depicts a partial view of the substantially cylindrical open-ended polymeric bullet-end 18 having a shoulder 24*a* forming chamber neck 26*a* and a bullet aperture 58. The interference of the bullet (not shown) to the neck 26*a* can be increased by adding polymer to the inside of the neck 26*a* or making the neck from a more ridged polymer. The substantially cylindrical open-ended polymeric bullet-end 18 includes an external shoulder 24*a* and an external neck 26*a* that are of fixed dimension as requires by the chamber (not shown) in which they fit. As a result, the shoulder length extends from the external neck 26*a* to the external side wall 29*a* as a fixed length. Similarly, the external shoulder plane angle 27*a* relative to the external neck 26*a* (or alternatively to the external side wall 29*a*) is a fixed angle relative to the chamber. Similarly, the substantially cylindrical open-ended polymeric bullet-end 18 includes an internal shoulder 24*b* and an internal neck 26*b* that are not of fixed dimension but may be varied as desired. In some embodiments, the internal shoulder 24*b* may be connected to one or more transition segments 24*c* to form a transition from the internal shoulder 24*b* to the internal neck 26*b* or the internal side wall 29*b*. The one or more transition segments 24*c* may be straight, curved or a mix thereof. For example, the internal shoulder 24*b* is connected to one or more transition segments 24*c* (although 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or more segments can be used). The internal shoulder 24*b* extends from the internal shoulder top 25*b* to the internal shoulder bottom 25*c*. The internal shoulder 24*b* has a shoulder plane angle 27*b* that is the same as the external shoulder plane angle 27*a*. Therefore the internal shoulder 24*b* is parallel to the shoulder 24*a* over the internal shoulder length. The one or more transition segments 24*c* have a transition plane angle 27*c* that is larger than the external shoulder plane angle 27*a* and the internal shoulder plane angle 27*b*. The one or more transition segments 24*c* extend from the internal shoulder bottom 25*c* to the transition bottom 25*d*; however, the transition plane angle 27*c* is not the same as the external shoulder plane angle 27*a* or the internal shoulder plane angle 27*b*. Although this example depicts an internal shoulder 24*b* and one or more transition segments 24*c*, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or more internal shoulders and/or transition segments 24*c* can be used.

Therefore the internal shoulder 24*b* is parallel to the external shoulder 24*a* over the internal shoulder length. The skilled artisan will readily understand that the transition plane angle 27*c* can be adjusted to move the transition bottom 25*d* up and down the interior side wall 29*b*. Similarly the number of transition segments 24*c* can be varied to adjust to move the transition bottom 25*d* up and down the interior side wall 29*b*. In addition, the transition segments 24*c* may be a plethora of short segments connected together to from an arc or radii. The number of transition segments 24*c* may be such that an almost smooth arc is formed or so few that an angular profile is formed. Similarly, the angle of each transition segments 24*c* relative to the adjacent transition segments may be similar or different as necessary.

The external shoulder 24*a*, the external neck 26*a*, and the external shoulder plane angle 27*a* have fixed values to mate them to the chamber. The relationship between the external shoulder 24*a*, an external neck 26*a*, and external shoulder plane angle 27*a* are caliber ammunition and weapons platform specific and have values. In contrast, the internal shoulder 24*b*, the internal neck 26*b*, and the internal shoulder plane angle 27*b* have no such constraints and can be varied to form the desired internal shoulder profile.

For example, when the internal shoulder plane angle 27*b* is the same as the external shoulder plane angle 27*a* the external shoulder 24*a* and internal shoulder 24*b* are parallel. When the internal shoulder plane angle 27*b* is the same as the external shoulder plane angle 27*a*, the external shoulder 24*a* and internal shoulder 24*b* are parallel. When the internal shoulder plane angle 27*b* is the larger than the external shoulder plane angle 27*a*, internal shoulder 24*b* is longer than the external shoulder 24*a* such that the internal shoulder 24*b* transitions to the internal side wall 29*b* at a distance further away from the external shoulder 24*a*. Thus making a larger distance from the internal shoulder 24*b* to the external shoulder 24*a* as you move toward the shoulder bottom 25*c*. Conversely, when the internal shoulder plane angle 27*b* is the smaller than the external shoulder plane angle 27*a*, there is a larger distance from the internal shoulder 24*b* to the external shoulder 24*a* as you move up the shoulder toward internal shoulder 24*b*.

Figure 6:
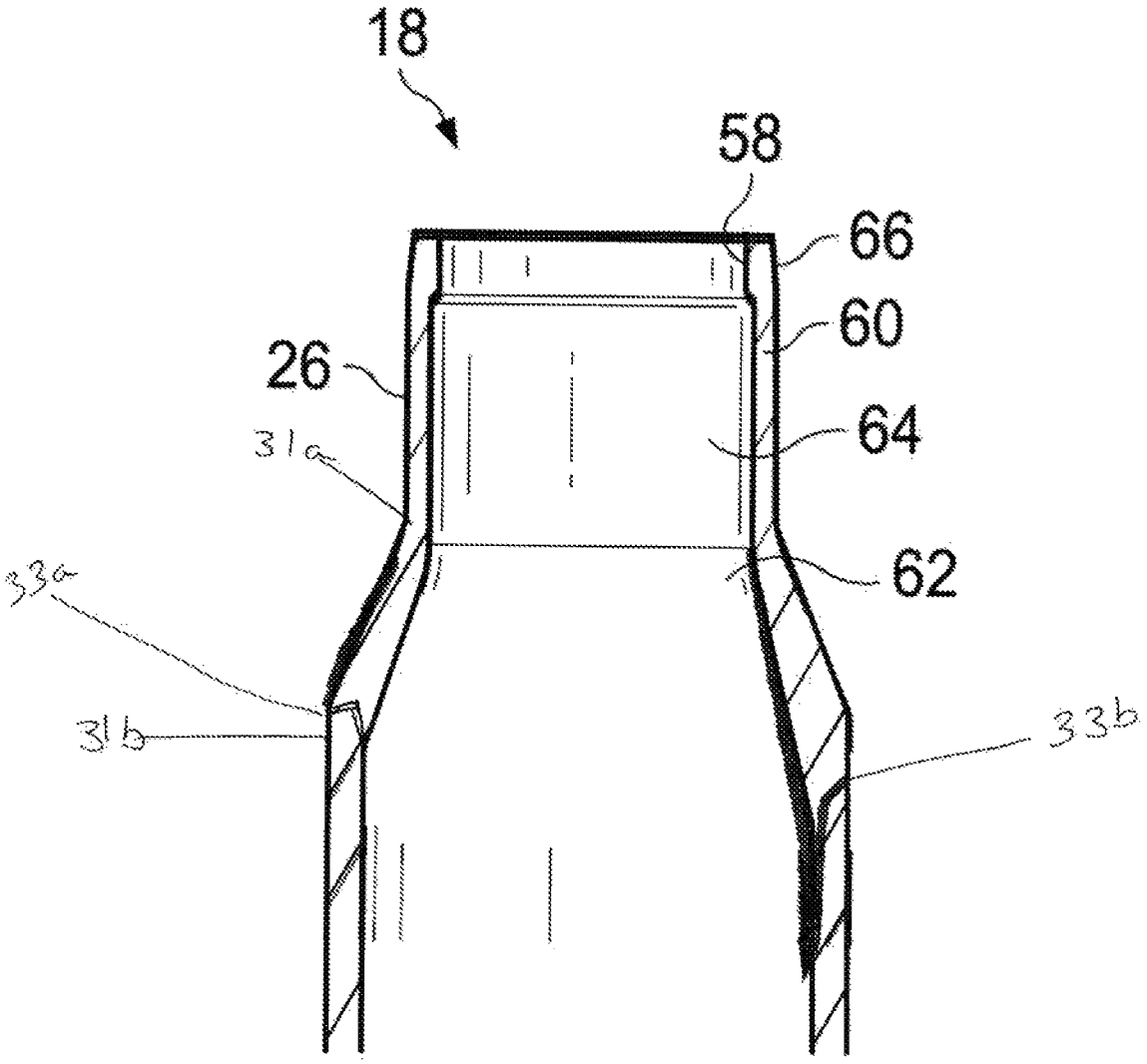
FIGS. 6-14 depict a partial view of a 2 piece polymer case having a nose and a mid-case connected at a joint.
Figure 7:
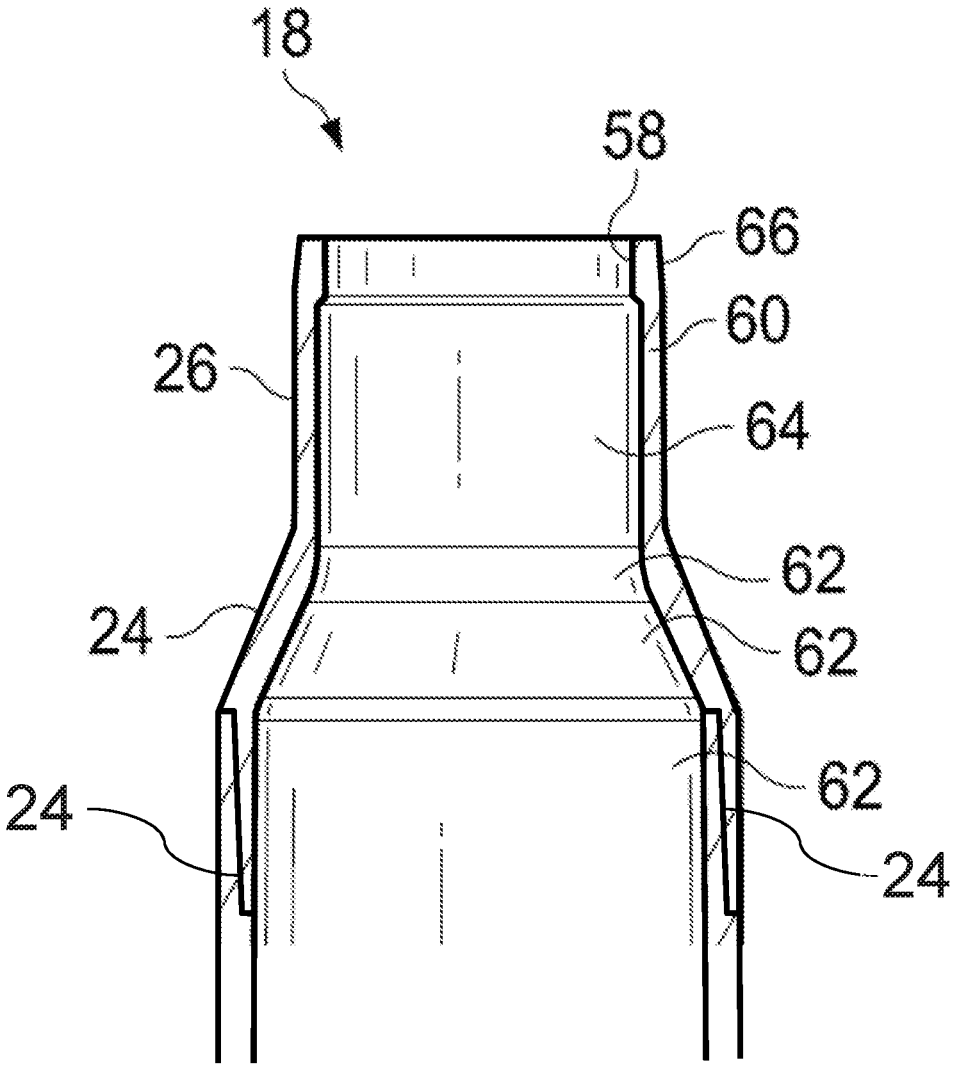
Figure 8:
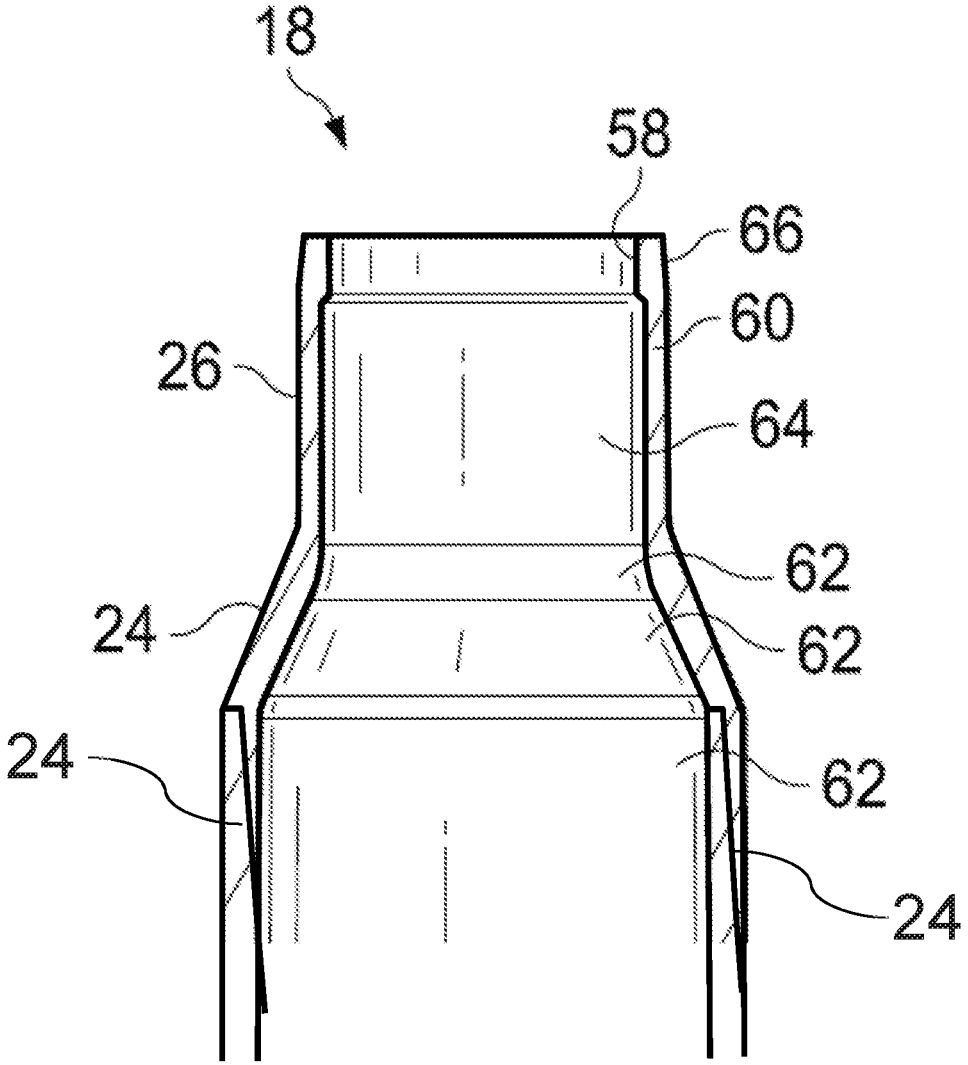
Figure 9:
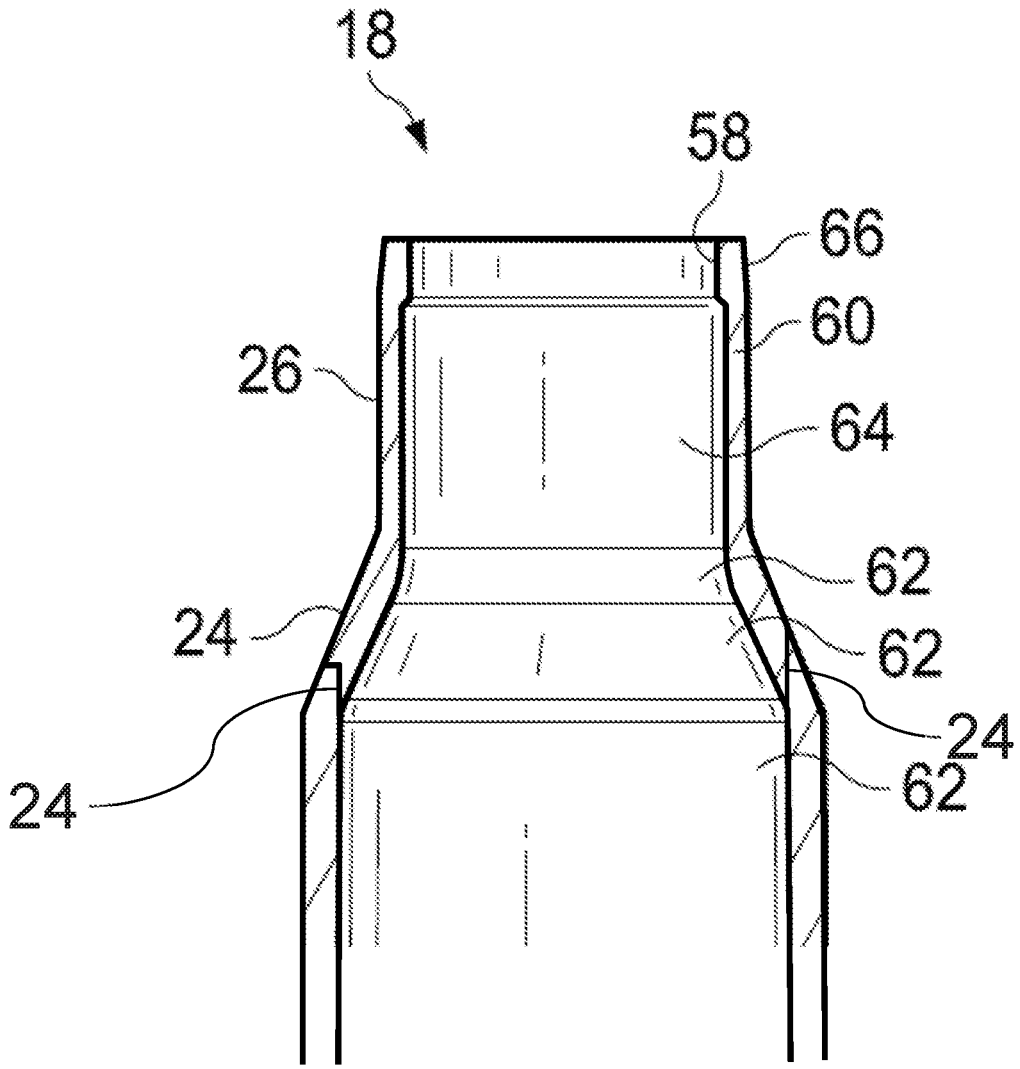
Figure 10:
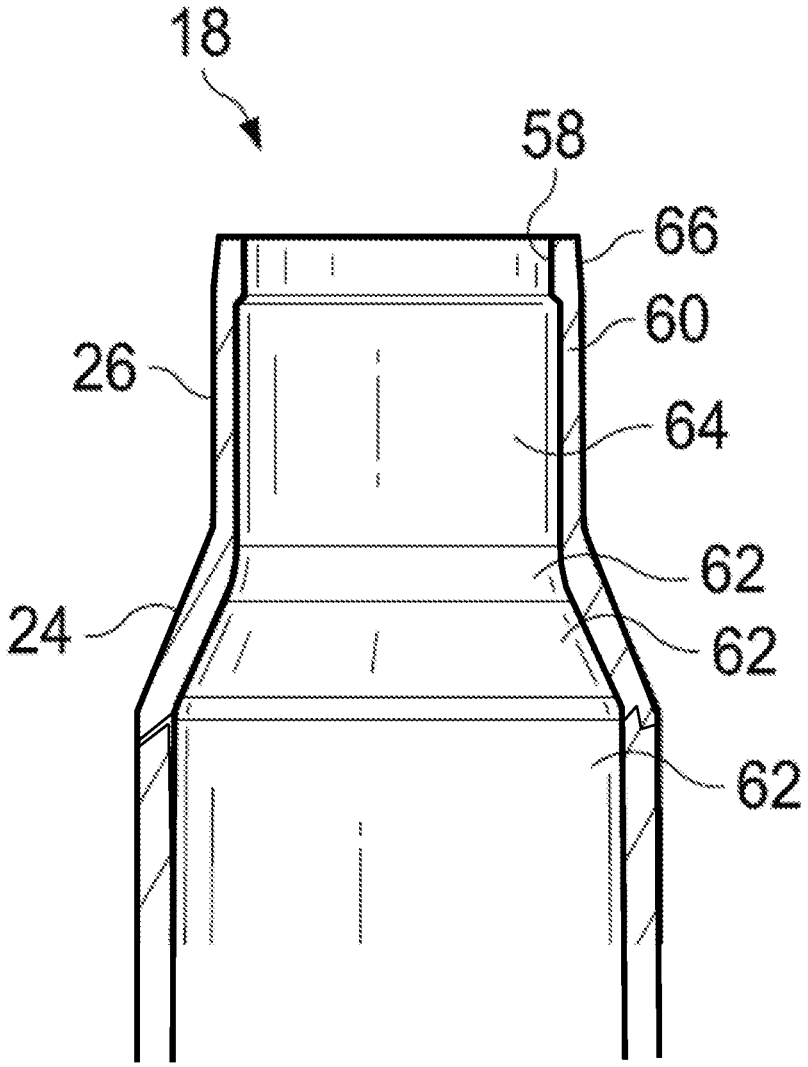
Figure 11:
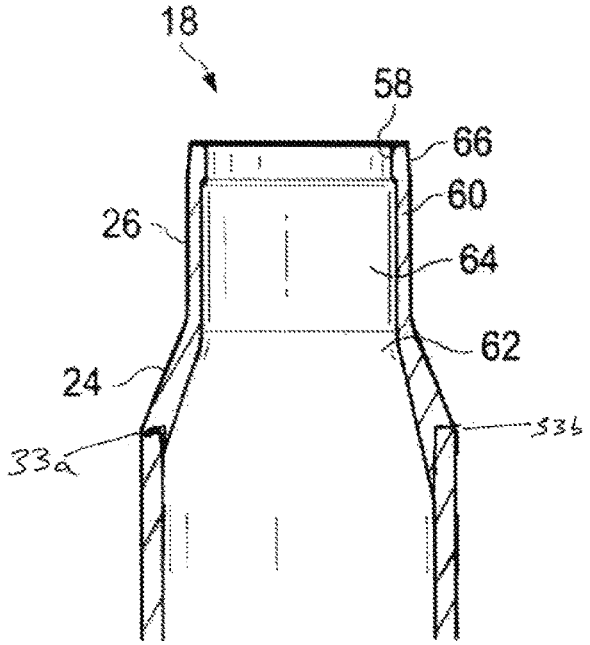
Figure 12:
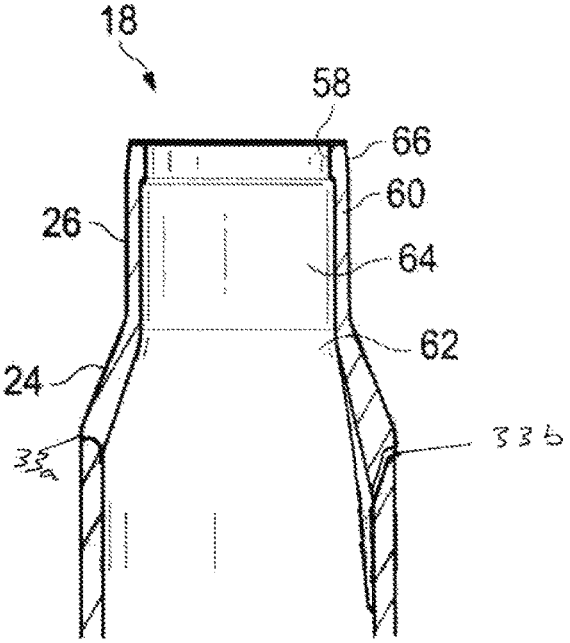
Figure 13:
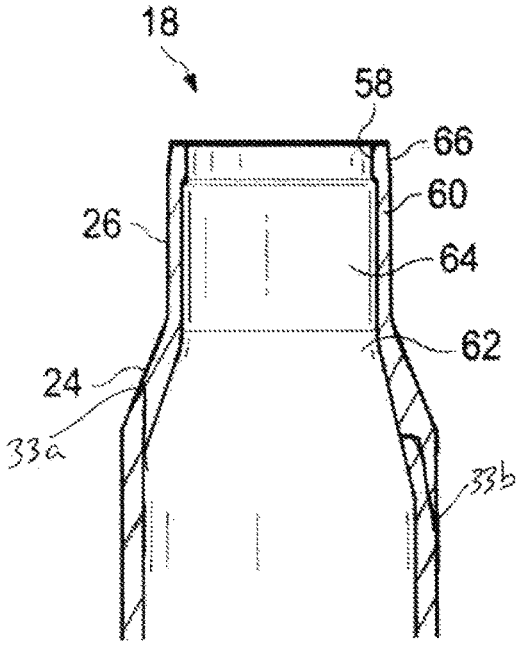
Figure 14:
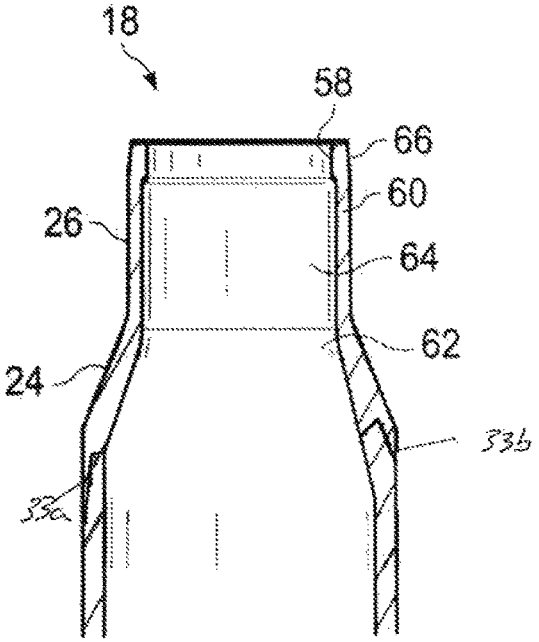

FIG. 6 depicts a partial view of a 2 piece polymer case having a nose and a mid-case connected at a joint. The joint may be located in the middle body component 28 or in the middle body-shoulder transition region 31*a* to 31*b*. Specifically, the joint 33*a* and 33*b* may be located anywhere within the middle body-shoulder transition region 31*a* to 31*b*. The mid-case-shoulder transition region 31*a* covers the neck 26 to shoulder transition area and extends to the shoulder-mid-case transition region. The mid-case-shoulder transition region 31*b* is located on the upper portion of the middle body component 28. The joint 31 may be of any configuration that allows the connection of the nose 18 and the middle body component 28. For example, the joint may be a butt joint, a bevel lap splice joint, a half lap joint, a lap joint, a square joint, a single bevel joint, double bevel joint, single J joint, double J joint, single v joint, double v joint, single U joint, double U joint, flange joint, tee joint, flare joint, edge joint, rabbit joint, dado and any other joint. In addition, the joint type may be modified to allow a gap at regions in the joint. For example, a dado joint may be formed where the fit is not square allowing gaps to form at the corner of the dado. Similarly, a compound joint may be used, e.g., rabbit joint transitioning to a butt joint transitioning to a bevel joint (modified to have a gap in the fit) transitioning to a butt joint and ending in a lap joint or rabbit joint. In addition the angle of the joint need not be at 90 and 180 degrees. The joint angle may be at any angle from 0-180 degrees and may vary along the joint. For instance the joint may start at a 0 degree move to a +45 degree angle transition to a −40 degree angle and conclude by tapering at a 10 degree angle. The Variation in the joint type, position, and internal shoulder length, internal shoulder angle, transition region angle, transition region length and other parameters are shown in FIGS. 6-14.

The chamber neck 26 and the internal neck 26*b* are shown as generally parallel to each other; however, the chamber neck 26 and the internal neck 26*b* may be tapered such that at the mouth 58 the distance from the chamber neck 26 to the internal neck 26*b* is less than the distance from the chamber neck 26 to the internal neck 26*b* at the shoulder 24. In addition, the mouth 58 may include a groove (not shown) that extends around the internal neck 26*b*. The internal neck 26*b* may include a texturing; however, distance from the internal neck 26*b* to the chamber neck 26 may be accessed using the average distance from the top texture surface (not shown) to the bottom texture surface (not shown) of the texturing, the top texture surface (not shown) of the texturing or the bottom texture surface (not shown) of the texturing.

Figures 15, 16:
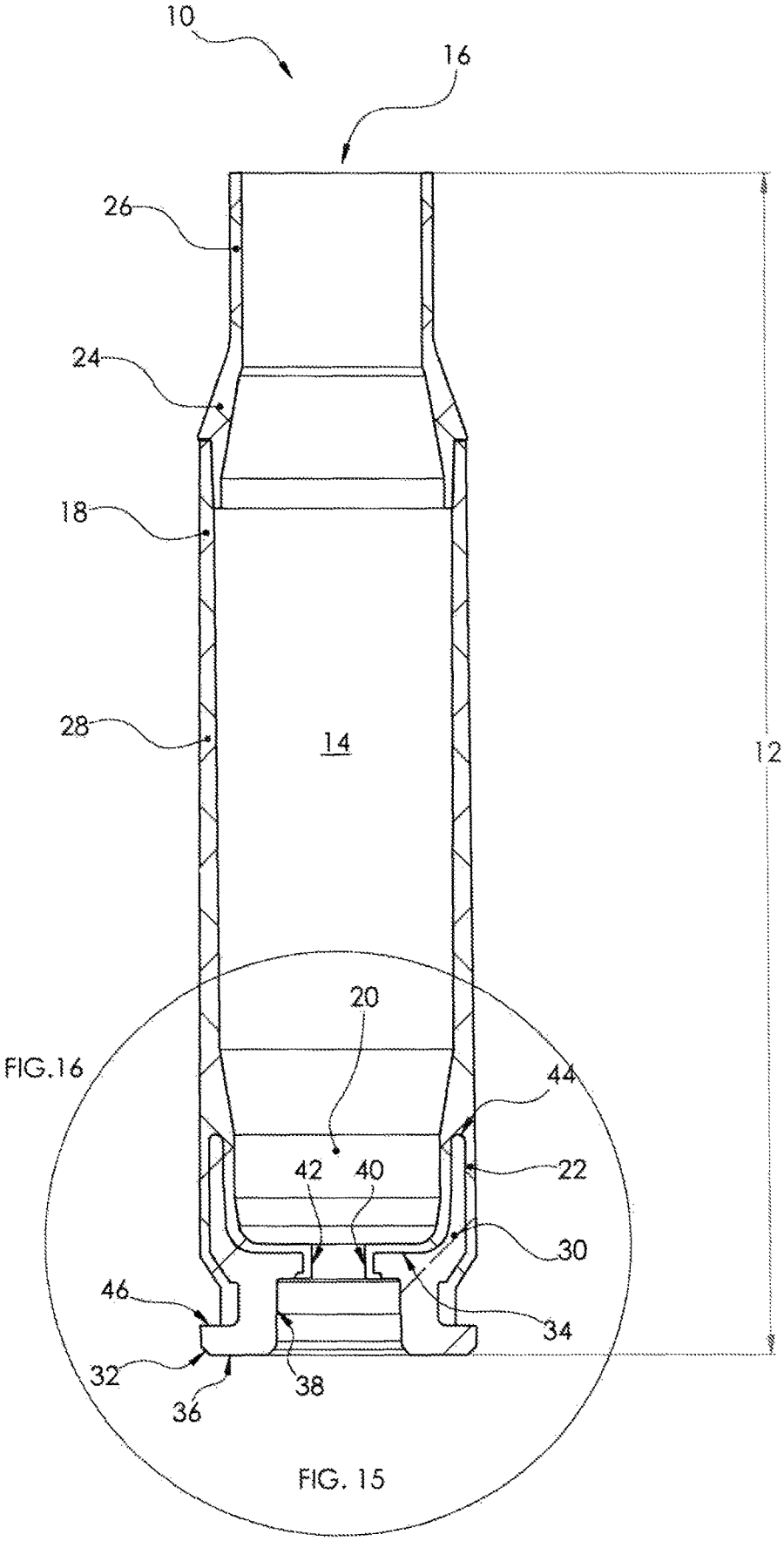
FIG. 15 depicts a side, cross-sectional view of a polymeric cartridge case according to one embodiment of the present invention.
FIG. 16 depicts a side, cross-sectional view of a portion of the polymeric cartridge case according to one embodiment of the present invention.
Figure 16:
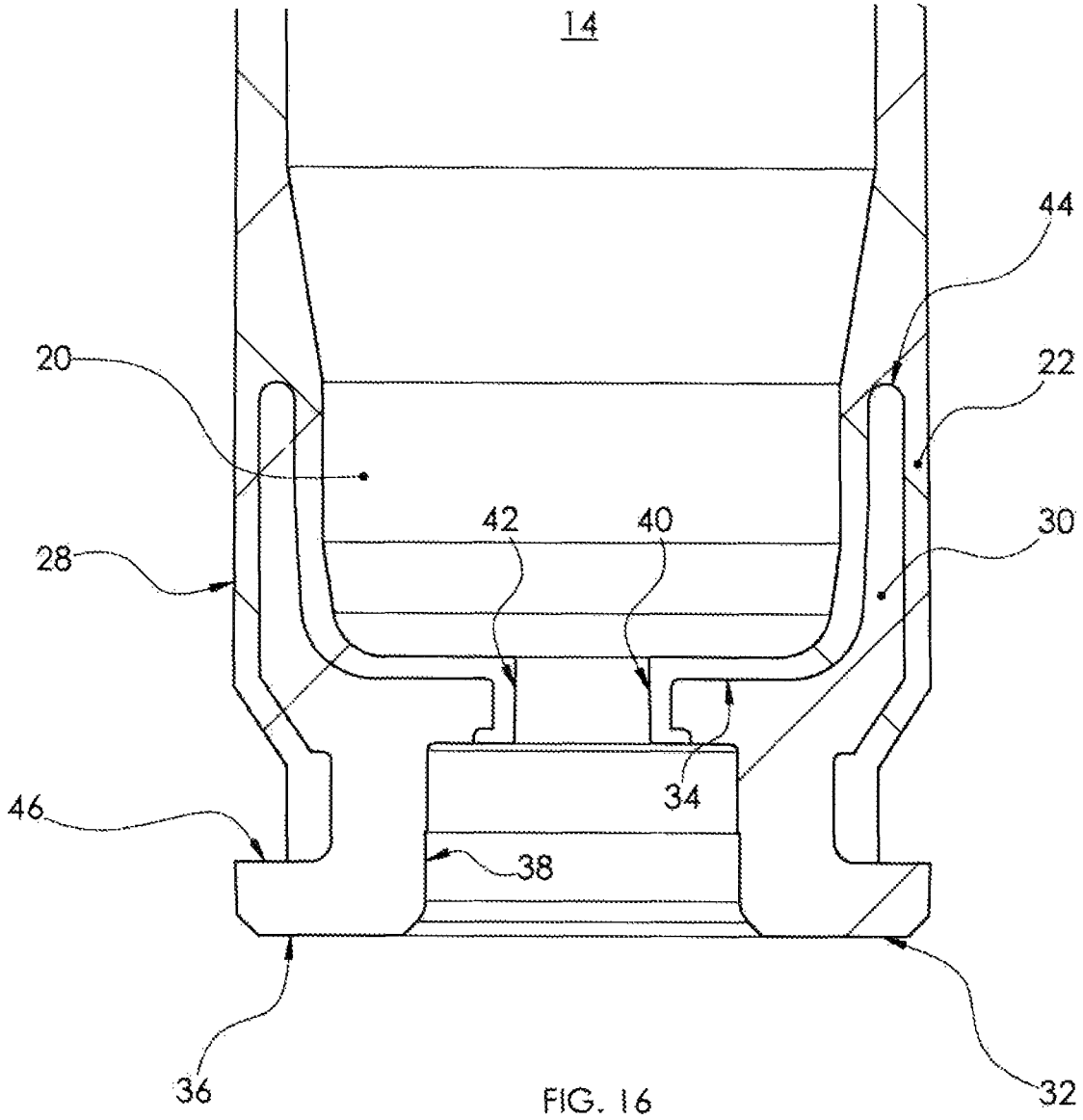
Figures 16, 19:
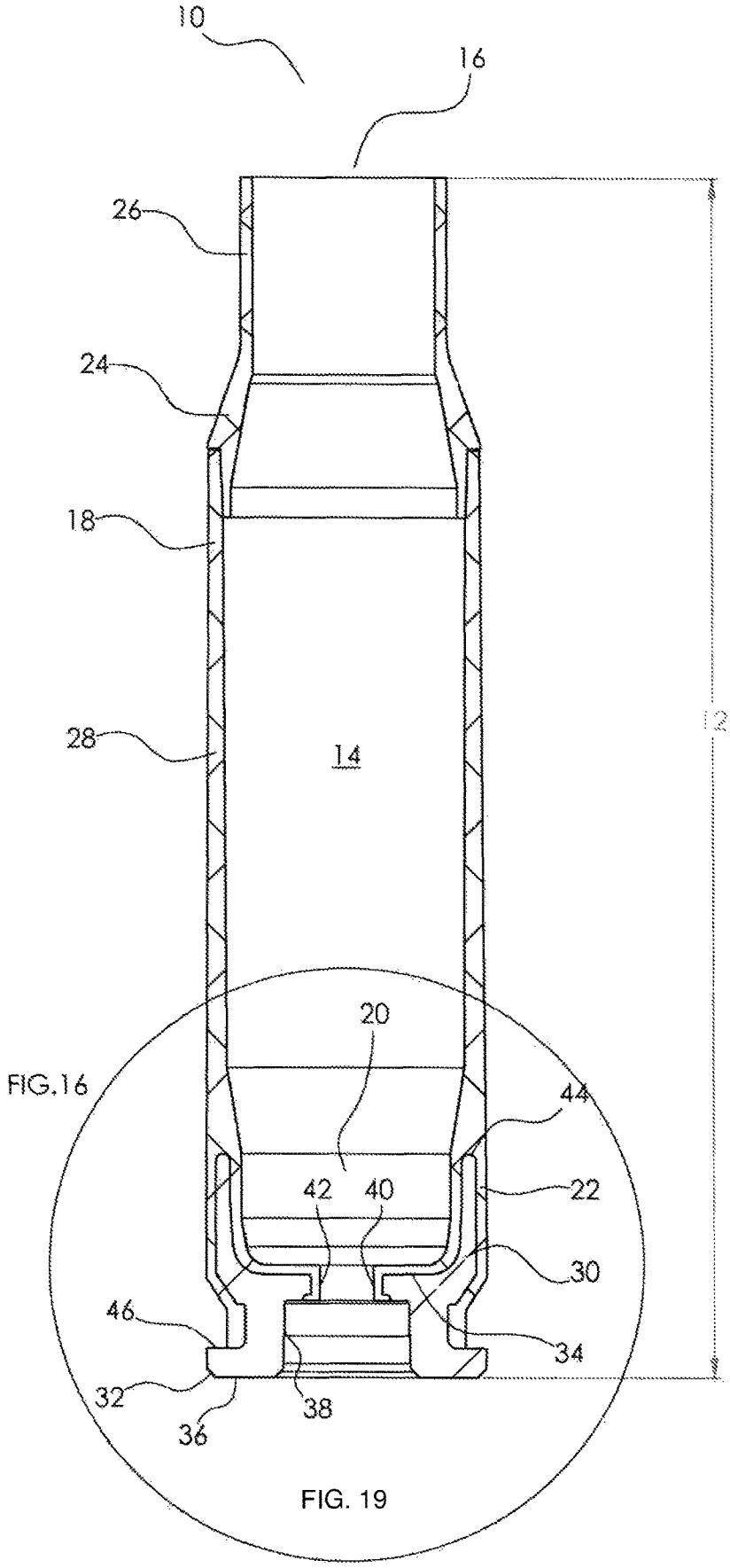
FIG. 19 depicts a side, cross-sectional view of a polymeric cartridge case according to one embodiment of the present invention.

FIGS. 15 and 19 depict a side, cross-sectional view of a polymeric cartridge case according to one embodiment of the present invention. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches. The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches. The bullet-end 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used. The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the powder chamber 14 so that upon detonation of primer (not shown) the powder in powder chamber 14 will be ignited. Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature. The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 20:
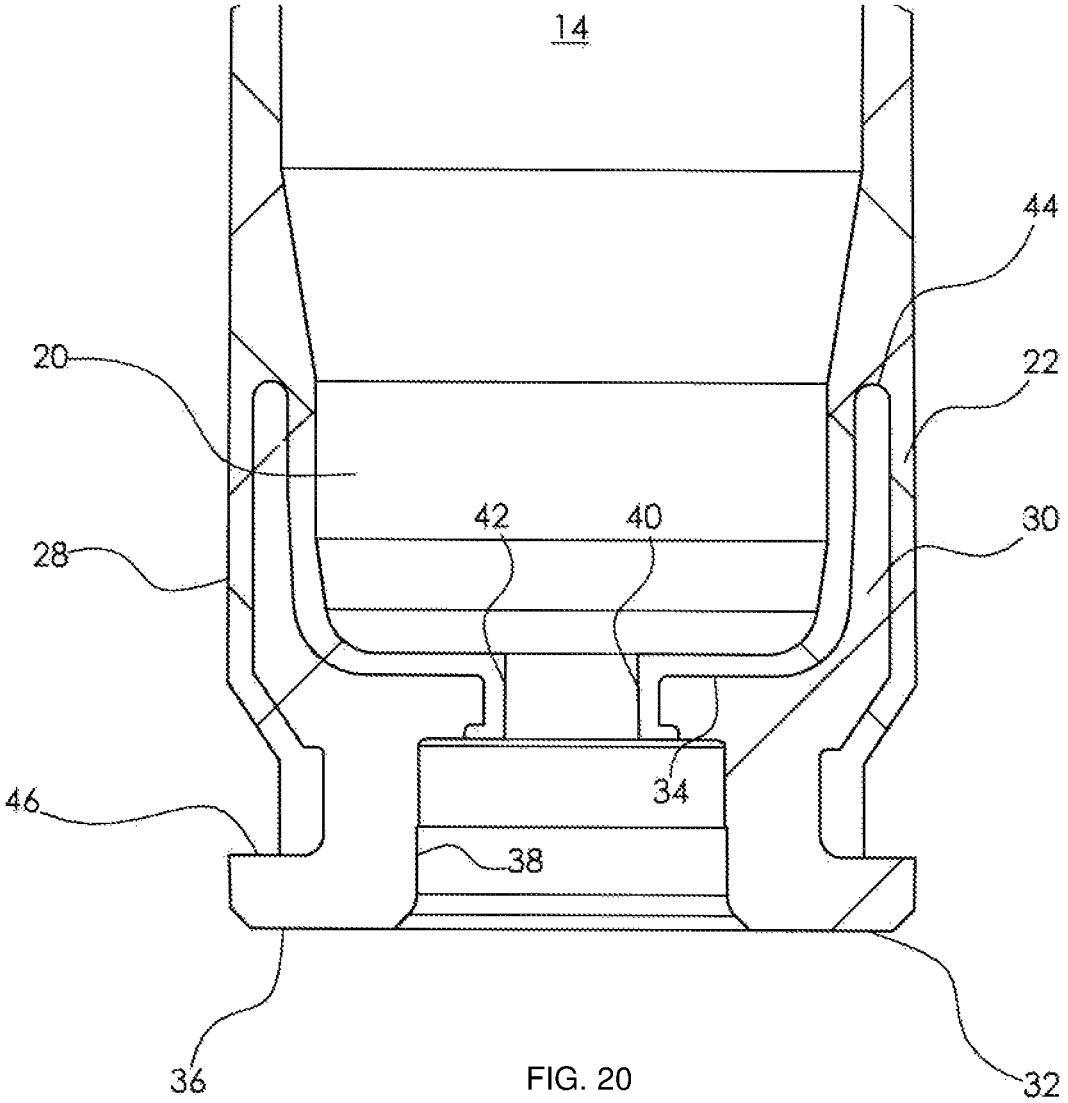
FIG. 20 depicts a side, cross-sectional view of a portion of the polymeric cartridge case according to one embodiment of the present invention.

FIGS. 16 and 20 depict a side, cross-sectional view of a portion of the polymeric cartridge case according to one embodiment of the present invention. A portion of a cartridge suitable for use with high velocity rifles is shown manufactured with a polymer casing 12 showing a powder chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer recess 28 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

Figure 17:
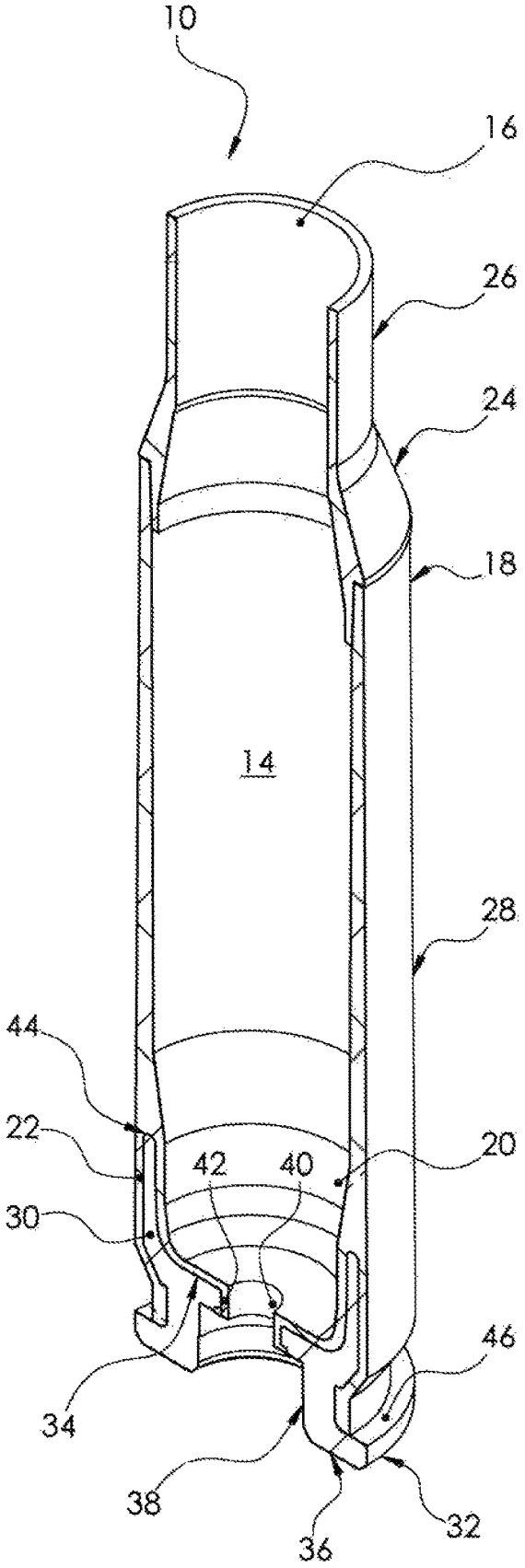
FIG. 17 depicts an isometric cross-sectional view of a polymeric cartridge case according to one embodiment of the present invention.
Figure 21:
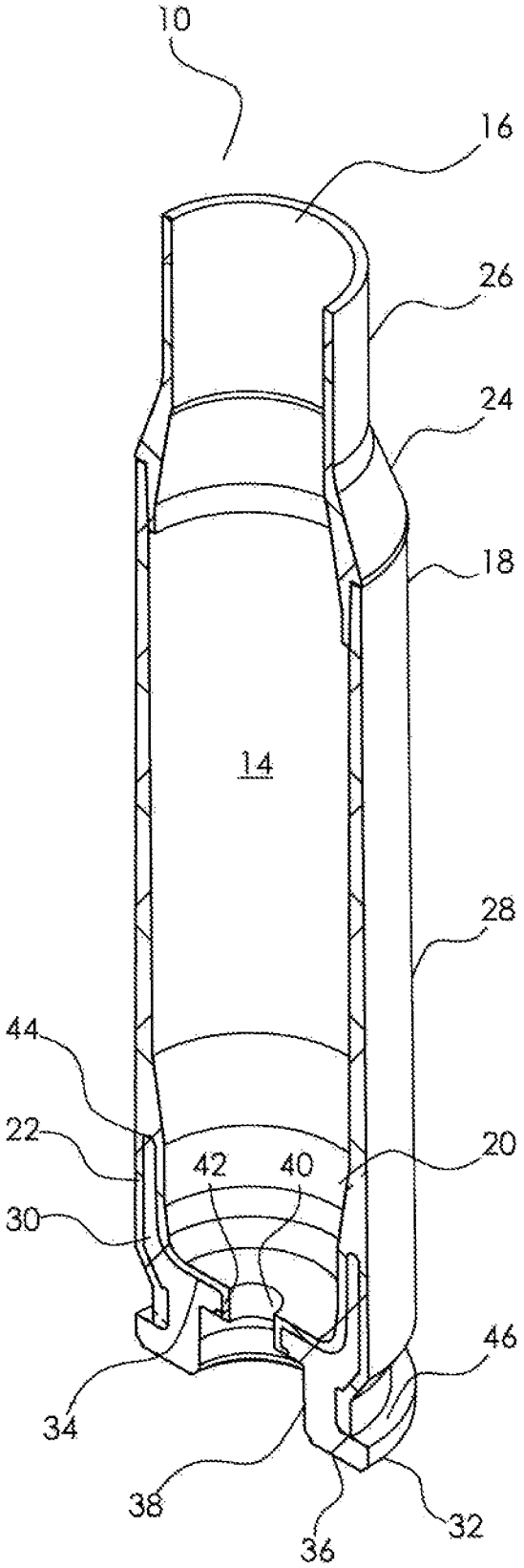
FIG. 21 depicts an isometric cross-sectional view of a polymeric cartridge case according to one embodiment of the present invention.

FIGS. 17 and 21 depict a side, cross-sectional view of a polymeric cartridge case according to one embodiment of the present invention. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric bullet-end 18 extending from forward end opening 16 rearward to opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches. The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 is located in the primer flash hole 40 and extends through the bottom surface 34 into the powder chamber 14. The coupling end 22 extends the polymer through the primer flash hole 40 to form an aperture coating 42 while retaining a passage from the top surface 36 through the bottom surface 34 and into the powder chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches. The bullet-end 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used. The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the powder chamber 14 so that upon detonation of primer (not shown) the powder in powder chamber 14 will be ignited. Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature. The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 18:
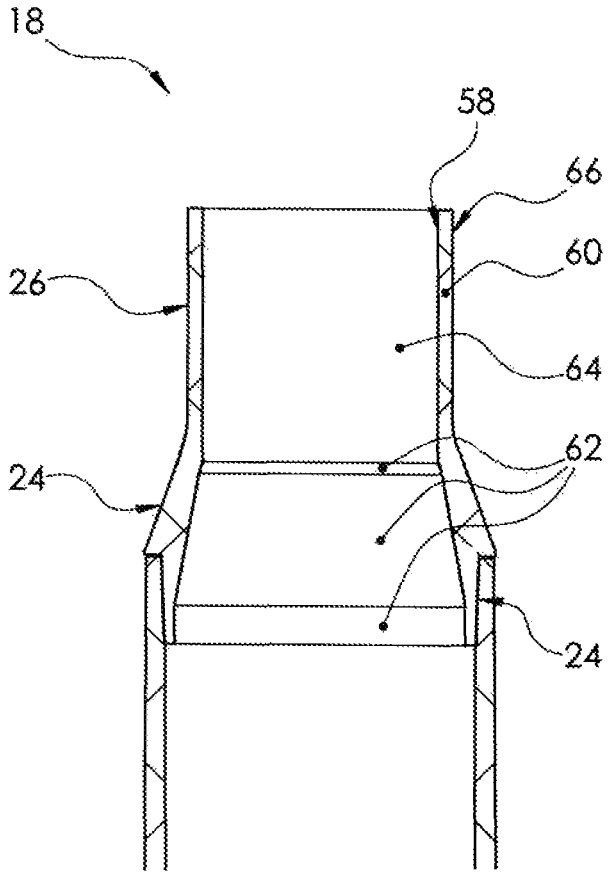
FIG. 18 depicts a partial view of a 2 piece polymer case having a nose and a mid-case connected at a joint.
Figure 22:
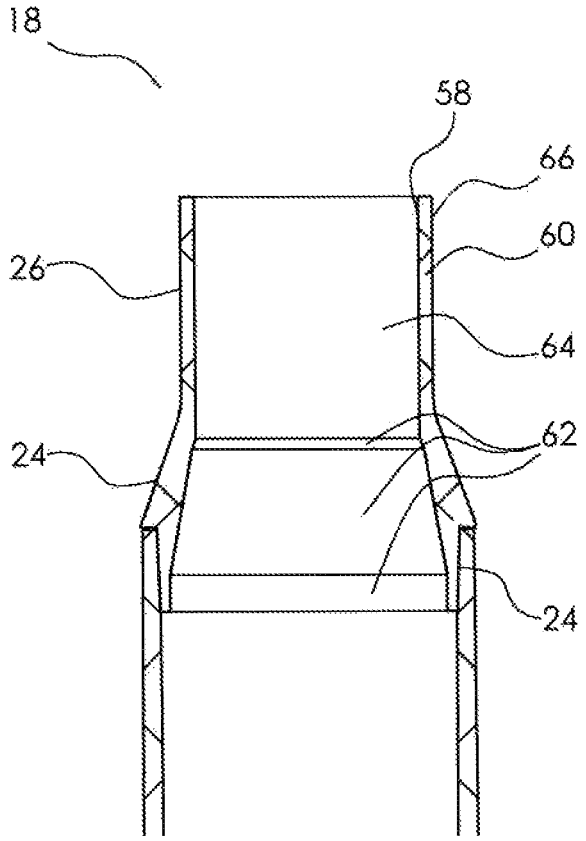
FIG. 22 depicts a partial view of a 2 piece polymer case having a nose and a mid-case connected at a joint.
Figure 23:
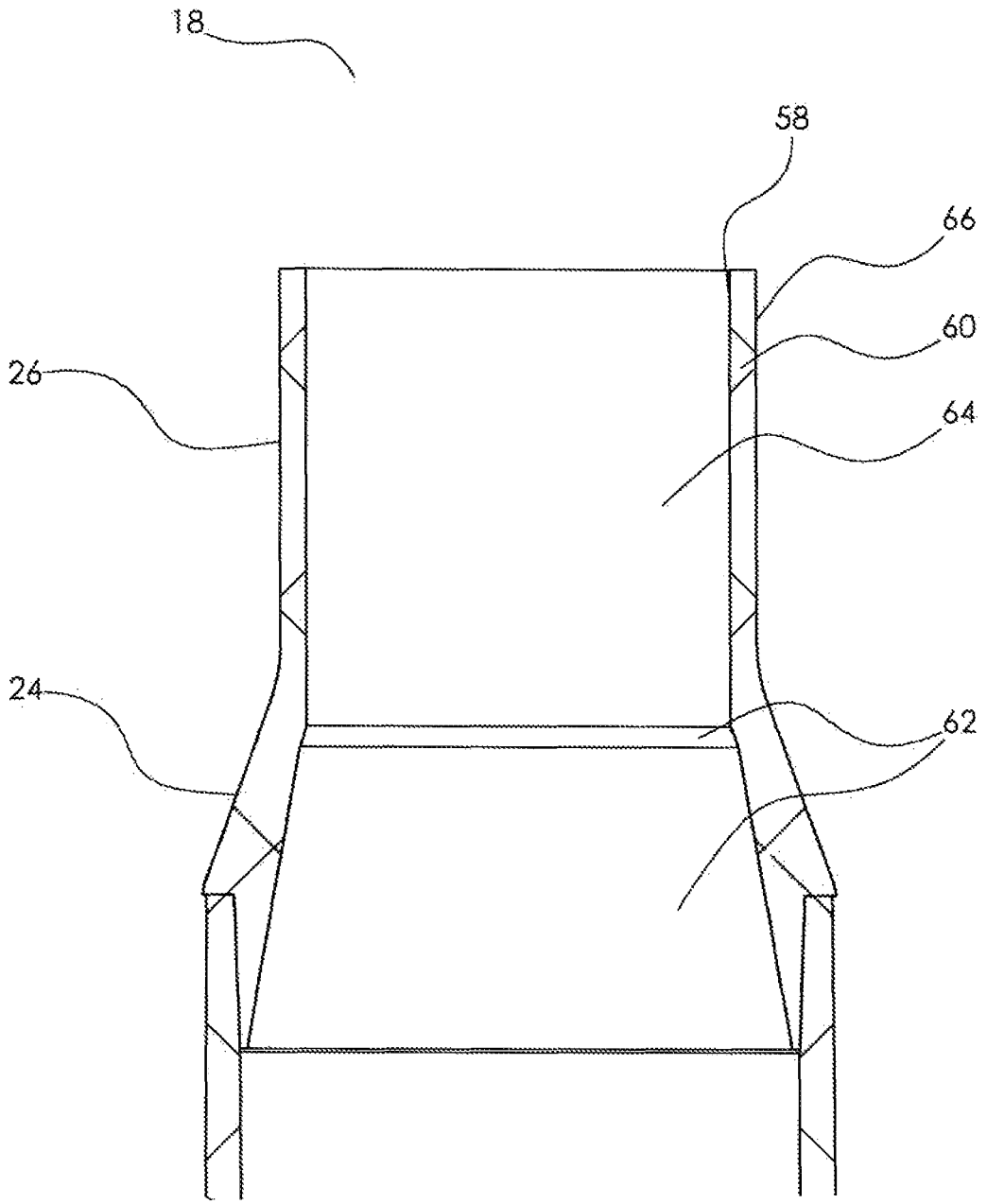
FIG. 23 depicts a partial view of a 2 piece polymer case having a nose and a mid-case connected at a joint.

FIGS. 18, 22 and 23 depict a partial view of a 2 piece polymer case having a nose and a mid-case connected at a joint. The joint may be located in the middle body component 28 or in the middle body-shoulder transition region 31*a* to 31*b*. Specifically, the joint 33*a* and 33*b* may be located anywhere within the middle body-shoulder transition region 31*a* to 31*b*. The mid-case-shoulder transition region 31*a* covers the neck 26 to shoulder transition area and extends to the shoulder-mid-case transition region. The mid-case-shoulder transition region 31*b* is located on the upper portion of the middle body component 28. The joint 31 may be of any configuration that allows the connection of the nose 18 and the middle body component 28. For example, the joint may be a butt joint, a bevel lap splice joint, a half lap joint, a lap joint, a square joint, a single bevel joint, double bevel joint, single J joint, double J joint, single v joint, double v joint, single U joint, double U joint, flange joint, tee joint, flare joint, edge joint, rabbit joint, dado and any other joint. In addition, the joint type may be modified to allow a gap at regions in the joint. For example, a dado joint may be formed where the fit is not square allowing gaps to form at the corner of the dado. Similarly, a compound joint may be used, e.g., rabbit joint transitioning to a butt joint transitioning to a bevel joint (modified to have a gap in the fit) transitioning to a butt joint and ending in a lap joint or rabbit joint. In addition the angle of the joint need not be at 90 and 180 degrees. The joint angle may be at any angle from 0-180 degrees and may vary along the joint. For instance the joint may start at a 0 degree move to a +45 degree angle transition to a −40 degree angle and conclude by tapering at a 10 degree angle. The Variation in the joint type, position, and internal shoulder length, internal shoulder angle, transition region angle, transition region length and other parameters are shown.

The insert may be made by any method including MIM, cold forming, milling, machining, printing, 3D printing, etching and so forth.

The polymeric and composite casing components may be injection molded including overmolding into the flash aperture. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, ionomers, polyamides, polyamide-imides, polyacrylates, polyetherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyetherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a Nylon 6 (polymer) based material. In this embodiment the polymer in the base includes a lip or flange to extract the case from the weapon. One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The extracting inserts is used to give the polymer case a tough enough ridge and groove for the weapons extractor to grab and pull the case out the chamber of the gun. The extracting insert is made of 17-4 ss that is hardened to 42-45 rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A polymeric ammunition having a 2 piece case comprising:

an primer insert comprising a top surface opposite a bottom surface and a substantially cylindrical coupling element that extends from the bottom surface, a primer recess in the top surface that extends toward the bottom surface, a primer flash hole aperture positioned in the primer recess to extend through the bottom surface, and a groove positioned around the primer flash hole aperture in the primer recess;

a polymeric middle body comprising a polymeric body extending from a body coupling over at least a portion of the primer insert, wherein the polymeric body is molded over the cylindrical coupling element and into the primer flash hole aperture and into the groove to form a primer flash hole;

a polymer nose comprising a generally cylindrical neck having a projectile aperture at a first end;

an outer shoulder surface that extends from the generally cylindrical neck;

an outer shoulder angle defined by the angle between the outer shoulder surface and the generally cylindrical neck;

an inner shoulder surface on the inside of the polymer nose opposite the outer shoulder surface, wherein the inner shoulder surface extends to an inner side surface;

an inner shoulder angle defined by the angle between the inner shoulder surface and the generally cylindrical neck wherein the inner shoulder angle is greater than the outer shoulder angle;

a nose junction formed at the shoulder, wherein the nose junction comprises a groove in the outer shoulder surface connected to an outer skirt surface that extends from the groove to a blunt skirt tip, wherein the outer skirt surface and the inner side surface meet at the blunt skirt tip, wherein a skirt angle is formed between the groove and the outer skirt surface is between 40 and 140 degrees and wherein the inner side surface extends to the blunt skirt tip;

a diffuser comprising a diffuser aperture positioned in the primer recess to align the diffuser aperture with the primer flash hole;

a primer inserted into the primer recess;

a propellant at least partially filling the propellant chamber; and a bullet frictionally fitted in the bullet-end aperture.

2. The polymer ammunition of claim 1, wherein the skirt is adapted to fit flush to the body coupling.

3. The polymer ammunition of claim 1, wherein the nose junction is a lap junction.

4. The polymer ammunition of claim 1, wherein the nose junction is a half lap junction.

5. The polymer ammunition of claim 1, wherein the inner side surface is adapted to not fit flush to a polymer cartridge.

6. The polymer ammunition of claim 1, wherein the inner shoulder surface is 10-100 percent longer than the outer skirt surface.

7. The polymer ammunition of claim 1, wherein the skirt angle is between 110 and 179 degrees.

8. The polymer ammunition of claim 1, wherein an angle formed between the nose junction and the outer skirt surface is about 90 degrees.

9. The polymer ammunition of claim 1, wherein an angle formed between the nose junction and the outer skirt surface is greater than 90 degrees.

10. The polymer ammunition of claim 1, wherein an angle formed between the nose junction and the outer skirt surface is less than 90 degrees.

11. The polymer ammunition of claim 1, wherein the shoulder comprises an outer shoulder surface having an outer angle opposite an inner shoulder surface having an inner angle and a skirt surface adjacent to the inner shoulder surface.

12. The polymer ammunition of claim 1, wherein the polymer nose, the polymeric middle body or both individually comprise a nylon polymer, polycarbonate polymer, polybutylene polymer or a mixture thereof.

13. The polymer ammunition of claim 1, wherein the polymer nose, the polymeric middle body or both individually comprise a fiber-reinforced polymeric composite.

14. The polymer ammunition of claim 1, wherein the polymer nose, the polymeric middle body or both individually comprise between about 10 and about 70 wt % glass fiber fillers, mineral fillers, or mixtures thereof.

15. The polymer ammunition of claim 1, wherein an adhesive groove is positioned in the projectile aperture.

16. The polymer ammunition of claim 1, wherein the polymer nose, the polymeric middle body or both individually comprise wherein the polymer nose, the polymeric middle body or both individually comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers.

* * * * *